US009109845B2

(12) United States Patent
Kim et al.

(10) Patent No.: US 9,109,845 B2
(45) Date of Patent: Aug. 18, 2015

(54) OUTDOOR HEAT EXCHANGER AND AIR CONDITIONER INCLUDING THE SAME

(71) Applicant: LG Electronics Inc., Seoul (KR)

(72) Inventors: Kakjoong Kim, Seoul (KR); Donghwi Kim, Seoul (KR); Yongcheol Sa, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 242 days.

(21) Appl. No.: 13/742,870

(22) Filed: Jan. 16, 2013

(65) Prior Publication Data

US 2013/0192287 A1 Aug. 1, 2013

(30) Foreign Application Priority Data

Jan. 20, 2012 (KR) ..... 10-2012-0006964

(51) Int. Cl.

| | |
|---|---|
| ***F28F 27/02*** | (2006.01) |
| ***F25B 39/00*** | (2006.01) |
| ***F25B 39/02*** | (2006.01) |
| *F25B 13/00* | (2006.01) |

(52) U.S. Cl.

CPC ..... *F28F 27/02* (2013.01); *F25B 39/00* (2013.01); *F25B 39/028* (2013.01); *F25B 13/00* (2013.01); *F28F 2250/06* (2013.01)

(58) Field of Classification Search

CPC ..... F28F 27/02; F28F 2250/06; F25B 39/028
USPC ..... 62/324.1
See application file for complete search history.

(56) References Cited

FOREIGN PATENT DOCUMENTS

JP 2003-121019 * 4/2003 ..... F25B 13/00

* cited by examiner

*Primary Examiner* — Cassey D Bauer
(74) *Attorney, Agent, or Firm* — Dentons US LLP

(57) ABSTRACT

An outdoor heat exchanger in cooling operation includes: a first header pipe into which a refrigerant compressed by a compressor flows; a first heat exchanging unit connected with the first header pipe and allowing a refrigerant to exchange heat with the air; a bypass pipe through which the refrigerant exchanging heat in the first heat exchanging unit flows; a first distribution pipe connected with the bypass pipe; a distribution pipe check valve that is disposed in the first distribution pipe and preventing the refrigerant exchanging heat in the first heat exchanging unit from passing through the first distribution pipe; a second header pipe into which the refrigerant passing through the bypass pipe flows; a second heat exchanging unit connected with the second header pipe and allowing a refrigerant to exchange heat with the air; and a second distribution pipe through which the refrigerant exchanging heat in the second heat exchanging unit passes.

9 Claims, 3 Drawing Sheets

OUTDOOR HEAT EXCHANGER AND AIR CONDITIONER INCLUDING THE SAME

CROSS-REFERENCE TO RELATED APPLICATION

This application claims the benefit of Korean Application No. 10-2012-0006964, filed on Jan. 20, 2012 in the Korean Intellectual Property Office, the disclosure of which is incorporated herein by reference.

BACKGROUND

1. Field of the Disclosure

The present invention relates to an outdoor heat exchanger and an air conditioner including the same, and more particularly, to an outdoor heat exchanger in which the passage of a refrigerant is alternated.

2. Description of the Conventional Art

In general, air conditioners are apparatuses that cool or heat an indoor, using a cooling cycle including a compressor, an outdoor heat exchanger, an expansion valve, and an indoor heat exchanger. That is, the air conditioners can be composed of a cooler that cools an interior and a heater that heats the interior. Further, the air conditioners may be implemented by a compatible air conditioner for cooling and heating which cools or heats an interior.

When the air conditioner is a compatible air conditioner for cooling and heating, it includes a 4-way valve that switches passage for a refrigerant compressed by a compressor, depending on cooling and heating. That is, a refrigerant compressed by a compressor flows into an outdoor heat exchanger through the 4-way valve and the outdoor heat exchanger functions as a condenser, in cooling operation. Further, the refrigerant compressed by the outdoor heat exchanger flows into an indoor heat exchanger after expanding through an expansion valve. In this operation, the indoor heat exchanger functions as an evaporator and the refrigerant evaporated by the indoor heat exchanger flows into the compressor again through the 4-way valve.

On the other hand, a refrigerant compressed by a compressor flows into the indoor heat exchanger through the 4-way valve and the indoor heat exchanger functions as a condenser, in heating operation. Further, the refrigerant compressed by the indoor heat exchanger flows into the outdoor heat exchanger after expanding through the expansion valve. In this operation, the outdoor heat exchanger functions as an evaporator and the refrigerant evaporated by the outdoor heat exchanger flows into the compressor again through the 4-way valve.

SUMMARY

The present invention has been made in an effort to provide an outdoor heat exchanger in which the passage of a refrigerant is alternated.

The objects of the present invention are not limited to those described above and other objects may be made apparent to those skilled in the art from claims.

In order to achieve the objects, an outdoor heat exchanger according to an exemplary embodiment of the present invention, which operates as a condenser in cooling operation and as an evaporator in heating operation in an air conditioner, includes: a first header pipe into which a refrigerant compressed by a compressor flows in cooling operation; a first heat exchanging unit connected with the first header pipe and allowing a refrigerant to exchange heat with the air; a bypass pipe through which the refrigerant exchanging heat in the first heat exchanging unit flows in cooling operation; a first distribution pipe connected with the bypass pipe; a distribution pipe check valve that is disposed in the first distribution pipe and preventing the refrigerant exchanging heat in the first heat exchanging unit from passing through the first distribution pipe in cooling operation; a second header pipe into which the refrigerant passing through the bypass pipe flows in cooling operation; a second heat exchanging unit connected with the second header pipe and allowing a refrigerant to exchange heat with the air; and a second distribution pipe through which the refrigerant exchanging heat in the second heat exchanging unit passes in cooling operation.

An air conditioner according to another exemplary embodiment of the present invention includes: a compressor; and an outdoor heat exchanger comprising, a first header pipe connected with the compressor, a first heat exchanging unit allowing a refrigerant to exchange heat with the air, one side of the first heat exchanging unit is connected with the first header pipe, a first distribution pipe connected with the other side of the first heat exchanging unit, a distribution pipe check valve disposed in the first distribution pipe and controlling the flow direction of a refrigerant, a bypass pipe connected with the first distribution pipe, a second header pipe connected with the first header pipe and the bypass pipe, a second heat exchanging unit allows a refrigerant to exchange heat with the air, one side of the second heat exchanging unit is connected with the second header pipe, and a second distribution pipe that is connected with the other side of the second heat exchanging unit.

The details of other exemplary embodiments are included in the following detailed description and the accompanying drawings.

DETAILED DESCRIPTION OF THE PREFERRED EMBODIMENT

Figure 1:
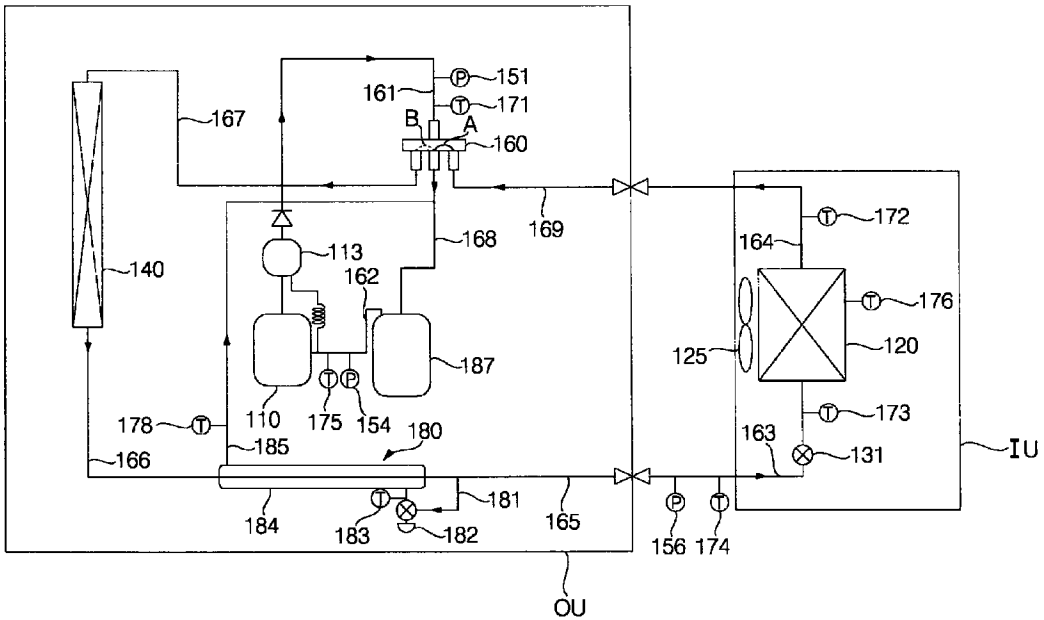
FIG. 1 is a diagram illustrating the configuration of an air conditioner according to an exemplary embodiment of the present invention.

The advantages and features of the present invention, and methods of achieving them will be clear by referring to the exemplary embodiments that will be describe hereafter in detail with reference to the accompanying drawings. However, the present invention is not limited to the exemplary embodiments described hereafter and may be implemented in various ways, and the exemplary embodiments are provided to complete the description of the present invention and let those skilled in the art completely know the scope of the present invention and the present invention is defined by claims. Like reference numerals indicate like components throughout the specification.

Hereinafter, the present invention will be described with reference to the drawings illustrating an outdoor heat exchanger according to exemplary embodiments of the present invention.

FIG. 1 is a diagram illustrating the configuration of an air conditioner according to an exemplary embodiment of the present invention.

An air conditioner according to an exemplary embodiment of the present invention includes an outdoor unit OU and an indoor unit IU.

The outdoor unit OU includes a compressor 110, an outdoor heat exchanger 140, and a supercooler 180. The air conditioner may include one or a plurality of outdoor units OU.

The compressor 110 compresses a low-temperature refrigerant flowing inside into a high-pressure and high-temperature refrigerant. Various structures may be used for the compressor 110, and an inverter type compressor or a constant-speed compressor may be used. A discharge temperature sensor 171 and a discharge pressure sensor 151 are disposed in a discharge pipe 161 of the compressor 110. Further, an intake temperature sensor 175 and an intake pressure sensor 154 are disposed in an intake pipe 162 of the compressor 110.

Although the outdoor unit OU includes one compressor 110, the present invention is not limited thereto and the outdoor unit OU may include a plurality of compressors and may include both of an inverter type compressor and a constant-speed compressor.

An accumulator 187 may be disposed in the intake pipe 162 of the compressor 110 to prevent a liquid-state refrigerant from flowing into the compressor 110. An oil separator 113 may be disposed in the discharge pipe 161 of the compressor 110 to recover oil from the refrigerant discharged from the compressor 110.

The 4-way valve 160, a passage switch valve for switching cooling/heating, guides the refrigerant compressed by the compressor 110 to the outdoor heat exchanger 140 in cooling operation and to the indoor heat exchanger 120 in heating operation. The 4-way valve 160 is in the status A in cooling operation and the status B in heating operation.

The outdoor heat exchanger 140 is disposed at an outdoor space and the refrigerant passing through the outdoor heat exchanger 140 exchanges heat with the external air. The outdoor heat exchanger 140 operates as a condenser in cooling operation and as an evaporator in heating operation.

The outdoor heat exchanger 140 is connected with a first inflow pipe 166 and to the indoor unit IU through a liquid line 165. The outdoor heat exchanger 140 is connected with the 4-way valve 160 through a second inflow pipe 167.

An outdoor expansion valve 132 controlling the degree of opening of the first inflow pipe 166 is disposed in the first inflow pipe 166. The outdoor expansion valve 132 can throttle or bypass the refrigerant passing through the first inflow pipe 166. The outdoor expansion valve 132 passes the refrigerant by fully opening in cooling operation and expands the refrigerant by controlling the degree of opening in heating operation.

The supercooler 180 includes a supercooling heat exchanger 184, a second bypass pipe 181, a supercooling expansion valve 182, and an exhaust pipe 185. The supercooling heat exchanger 184 is disposed in the first inflow pipe 166. The second bypass pipe 181 bypasses the refrigerant discharged from the supercooling heat exchanger 184 into the supercooling expansion valve 182 in cooling operation.

The supercooling expansion valve 182 is disposed in the second bypass pipe 181 and sends the liquid-state refrigerant, which flows into the second bypass pipe 181, into the supercooling heat exchanger 184, at the pressure and temperature reduced by throttling the refrigerant. Various kinds of expansion valves may be used as the supercooling expansion valve 182 and a linear expansion valve may be used for the convenience of use. A supercooling temperature sensor 183 that measures the temperature of the refrigerant throttled through the supercooling expansion valve 182 is disposed in the second bypass pipe 181.

In cooling operation, the refrigerant condensed in the outdoor heat exchanger 140 exchanges heat with the low-temperature refrigerant flowing inside through the second bypass pipe 181 in the supercooling heat exchanger 184, and then flows into the indoor unit IU.

The refrigerant that has passed through the second bypass pipe 181 exchanges heat in the supercooling heat exchanger 184 and then flows into the accumulator 187 through the exhaust pipe 185. An exhaust pipe temperature sensor 178 that measures the temperature of the refrigerant flowing into the accumulator 187 is disposed in the exhaust pipe 185.

A liquid line temperature sensor 174 and a liquid line pressure sensor 156 are disposed in the liquid line 165 connecting the supercooler 180 with the indoor unit IU.

In the air conditioner according to an exemplary embodiment of the present invention, the indoor unit IU includes an indoor heat exchanger 120, an indoor fan 125, and an indoor expansion valve 131. The air conditioner may include one or a plurality of indoor units IU.

The indoor heat exchanger 120 is disposed in an interior and the refrigerant passing through the indoor heat exchanger 120 exchanges heat with the interior air. The indoor heat exchanger 120 operates as an evaporator in cooling operation and as a condenser in heating operation. The indoor heat exchanger 120 is equipped with a room temperature sensor 176 that measures the room temperature.

The indoor expansion valve 131 is a device that throttles the refrigerant flowing inside in cooling operation. The indoor expansion valve 131 is disposed in an indoor inlet pipe 163 of the indoor unit IU. Various kinds of expansion valves may be used as the indoor expansion valve 131 and a linear expansion valve may be used for the convenience of use. The indoor expansion valve 131 may open at a predetermined degree of opening in cooling operation and may fully open in heating operation.

An indoor inlet pipe temperature sensor 173 is disposed in the indoor inlet pipe 163. The indoor inlet pipe temperature sensor 173 may be disposed between the indoor heat exchanger 120 and the indoor expansion valve 131. Further, an indoor outlet pipe temperature sensor 172 is disposed in an indoor outlet pipe 164.

The flow of a refrigerant in the air conditioner in cooling operation is as follows.

A liquid-state refrigerant at a high temperature and a high pressure discharged from the compressor 110 flows into the outdoor heat exchanger 140 through the 4-way valve 160 and the second inflow pipe 167. The refrigerant condenses in the outdoor heat exchanger 140 by exchanging heat with the external air. The refrigerant flowing out of the outdoor heat exchanger 140 flows into the supercooler 180 through the first inflow pipe 166. The inflow refrigerant flows into the indoor unit IU after supercooled through the supercooling heat exchanger 184.

Some of the refrigerant supercooled through the supercooling heat exchanger 184 is throttled through the supercooling expansion valve 182 and supercools the refrigerant passing through the supercooling heat exchanger 184. The refrigerant that has supercooled the refrigerant passing through the supercooling heat exchanger 184 flows into the accumulator 187.

The refrigerant flowing in the indoor unit IU is throttled through the indoor expansion valve 131 open at a predetermined degree of opening and then evaporated in the indoor heat exchanger 120 by exchanging heat with the interior air.

The evaporated refrigerant flows into the compressor 110 through the 4-way valve 160 and the accumulator 187.

The flow of a refrigerant in the air conditioner in heating operation is as follows.

The liquid-state refrigerant discharged at a high temperature and a high pressure from the compressor 110 flows into the indoor unit IU through the 4-way valve 160. The indoor expansion valve 131 in the indoor unit IU is fully opened. The refrigerant discharged from the indoor unit IU flows into the outdoor heat exchanger 140 through the first inflow pipe 166, expands through the outdoor expansion valve 132, and then evaporates in the outdoor heat exchanger 140 by exchanging heat with the external air. The evaporating refrigerant flows into the intake pipe 162 of the compressor 110 through the 4-way valve 160 and the accumulator 187 after passing through the second inflow pipe 167.

Figure 2:
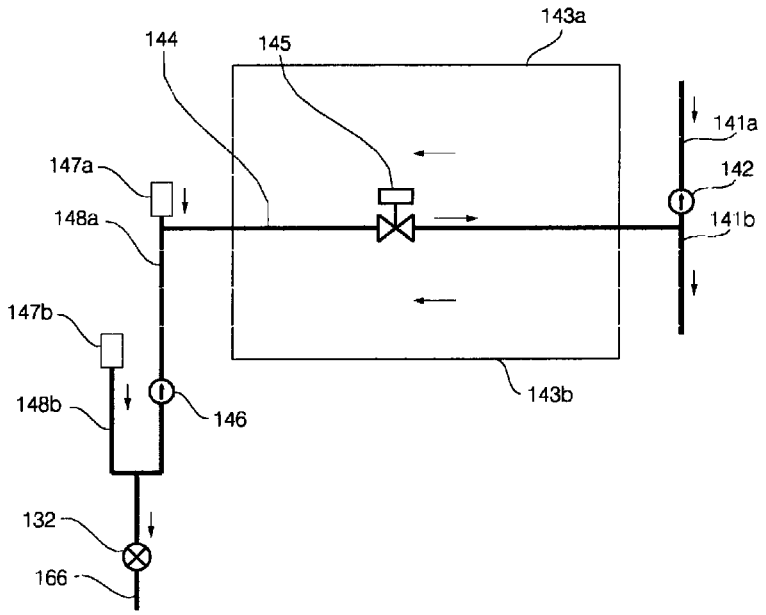
FIGS. 2 and 3 are diagrams illustrating the configuration of an outdoor heat exchanger according to an exemplary embodiment of the present invention.
Figure 3:
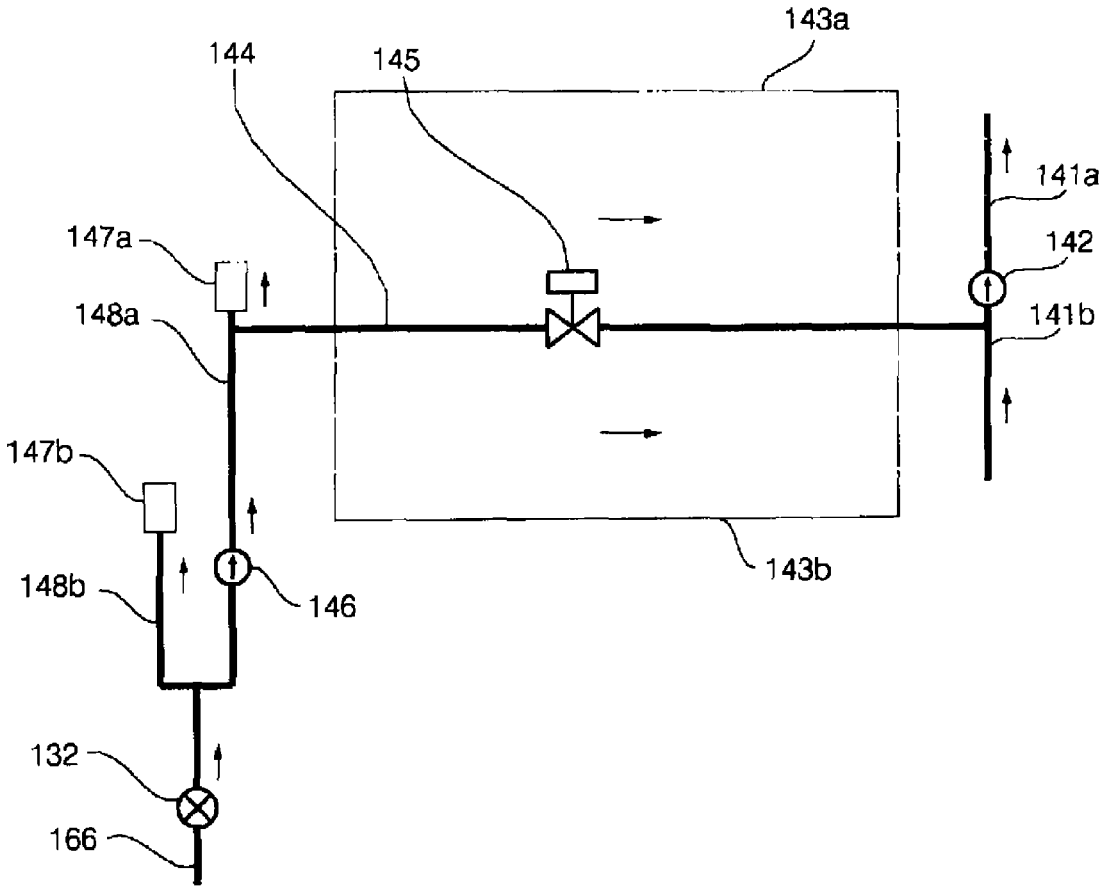

FIGS. 2 and 3 are diagrams illustrating the configuration of an outdoor heat exchanger according to an exemplary embodiment of the present invention.

The outdoor heat exchanger 140 according to an exemplary embodiment of the present invention includes a first header pipe 141*a* into which a refrigerant compressed by a compressor flows in cooling operation, a first heat exchanging unit 143*a* that is connected with the first header pipe 141*a* and allows a refrigerant to exchange heat with the air, a bypass pipe 144 through which the refrigerant exchanging heat in the first heat exchanging unit flows, a first distribution pipe 148*a* that is connected with the bypass pipe 144, a distribution pipe check valve 146 that is disposed in the first distribution pipe 148*a* and prevents the refrigerant exchanging heat in the first heat exchanging unit 143*a* from passing through the first distribution pipe 148*a* in cooling operation, a second header pipe 141*b* into which the refrigerant passing through the bypass pipe 144 flows in cooling operation, a second heat exchanging unit 143*b* that is connected with the second header pipe 141*b* and allows a refrigerant to exchange heat with the air, and a second distribution pipe 148*b* through which the refrigerant exchanging heat in the second heat exchanging unit 143*b* passes in cooling operation.

One end of the first header pipe 141*a* is connected with the compressor 110 by being the second inflow pipe 167. The other end of the first header pipe 141*a* is connected with the bypass pipe 144 and the second header pipe 141*b*. A header pipe check valve 142 is disposed at the other end of the first header pipe 141*a*. The header pipe check valve 142 prevents a refrigerant from flowing into the second header pipe 141*b* from the first header pipe 141*a* by controlling the flow direction of the refrigerant, but allows a refrigerant to flow into the first header pipe 141*a* from the second header pipe 141*b*.

The first header pipe 141*a* is connected with one side of the first heat exchanging unit 143*a*. The first header pipe 141*a* is connected with a plurality of refrigerant tubes of the first heat exchanging unit 143*a*. That is, the first header pipe 141*a* diverges to a plurality of refrigerant tubes of the first heat exchanging unit 143*a*.

The first heat exchanging unit 143*a* has one side connected with the first header pipe 141*a* and the other side connected with a first distributor 147*a*. The first heat exchanging unit 143*a* is composed of a plurality of refrigerant tubes and a plurality of thermal conducting fins and allows a refrigerant to exchange heat with the air. One side of each of the refrigerant tubes of the first heat exchanging unit 143*a* converges on the first header pipe 141*a* and the other sides converge on the first distributor 147*a*.

The first distributor 147*a* connects the other side of the heat exchanging unit 143*a* with the first distribution pipe 148*a*. The refrigerant tubes of the first heat exchanging unit 143*a* are converged and connected to the first distributor 147*a*.

The first distribution pipe 148*a* is connected with the first distributor 147*a*. The first distribution pipe 148*a* is connected with the other side of the first heat exchanging unit 143*a* by the first distributor 147*a*. The first distribution pipe 148*a* is connected with the first inflow pipe 166. The first distribution pipe 148*a* and the second distribution pipe 148*b* converge on the first inflow pipe 166.

A distribution check valve 146 controlling the flow direction of a refrigerant is disposed in the first distribution pipe 148*a*. The distribution pipe check valve 146 prevents a refrigerant from flowing to the first inflow pipe 166 from the first distributor 147*a*, but allows a refrigerant to flow to the first distributor 147*a* from the first inflow pipe 166. The distribution pipe check valve 146 prevents the refrigerant exchanging heat in the first heat exchanging unit 143*a* from passing through the first distribution pipe 148*a* in cooling operation.

The bypass pipe 144 has one end connected with the first distribution pipe 148*a* and the other end connected with the second header pipe 141*b*. A sluice valve 145 controlling the flow of a refrigerant by opening/closing is disposed in the bypass pipe 144. The sluice valve 145 can allow a refrigerant to flow from the first distributor 147*a* to the second header pipe 141*b* by opening in cooling operation and can prevent a refrigerant from flowing from the second header pipe 141*b* to the first distributor 147*a* by closing in heating operation.

The bypass pipe 144 may be connected with the first distributor 147*a* or the other side of the first heat exchanging unit 143*a*, depending on exemplary embodiments.

The second header pipe 141*b* is connected with the bypass pipe 144 and the first header pipe 141*a*. The second header pipe 141*b* is connected with one side of the second heat exchanging unit 143*b*. The second header pipe 141*b* is connected with a plurality of refrigerant tubes of the second heat exchanging unit 143*b*. That is, the second header pipe 141*b* diverges to a plurality of refrigerant tubes of the second heat exchanging unit 143*b*.

The second heat exchanging unit 143*a* has one side connected with the second header pipe 141*b* and the other side connected with a second distributor 147*b*. The second heat exchanging unit 143*b* is composed of a plurality of refrigerant tubes through which a refrigerant flows and a plurality of thermal conducting fins, and allows a refrigerant to exchange heat with the air. In the second heat exchanging unit 143*b*, one side of each of the refrigerant tubes converges on the second header pipe 141*b* and the other sides converge on the second distributor 147*b*.

The second heat exchanging unit 143*b* is disposed under the first heat exchanging unit 143*a*. That is, the first heat exchanging unit 143*a* and the second heat exchanging unit 143*b* are vertically arranged, such that the thermal conducting fins can be shared.

The second distributor 147*b* connects the other side of the second heat exchanging unit 143*b* with the second distribution pipe 148*b*. The refrigerant tubes of the second heat exchanging unit 143*b* are converged and connected to the second distributor 147*b*.

The second distribution pipe 148*b* is connected with the second distributor 147*b*. The second distribution pipe 148*b* is connected with the other side of the second heat exchanging unit 143*b* by the second distributor 147*b*. The second distribution pipe 148*b* and the second distribution pipe 148*b* converge on the first inflow pipe 166.

Referring to FIG. 2, the flow of a refrigerant in the outdoor heat exchanger in cooling operation is as follows.

The refrigerant compressed through the compressor 110 flows into the first header pipe 141*a* through the second inflow pipe 167. The refrigerant flowing into the first header pipe 141*a* is prevented from flowing into the second header pipe 141*b* by the check valve 142. The refrigerant flowing into the first header pipe 141*a* flows to the first heat exchanging unit 143*a*.

The refrigerant flowing to the first heat exchanging unit 143*a* condenses by exchanging heat with the air. The refrigerant condensing in the first heat exchanging unit 143*a* flows to the first distribution pipe 148*a* through the first distributor 147*a*. The refrigerant flowing into the first distribution pipe 148*a* is prevented from flowing to the first inflow pipe 166 by the distribution pipe check valve 146 and flows to the bypass pipe 144.

In cooling operation, the sluice valve 145 opens and the refrigerant that has passed through the bypass pipe 144 flows into the second header pipe 141*b*. The refrigerant flowing into the second header pipe 141*b* flows to the second heat exchanging unit 143*b*.

The refrigerant flowing to the second heat exchanging unit 143*b* condenses again by exchanging heat with the air. The refrigerant condensing in the second heat exchanging unit 143*b* flows to the second distribution pipe 148*b* through the second distributor 147*b* and then flows to the first inflow pipe 166. In cooling operation, since the outdoor expansion valve 132 fully opens, the refrigerant flowing into the first inflow pipe 166 flows to the indoor unit IU through the liquid line 165.

Referring to FIG. 3, the flow of a refrigerant in the outdoor heat exchanger in heating operation is as follows.

The refrigerant condensing through the indoor heat exchanging unit 120 of the indoor unit IU flows to the first inflow pipe 166 through the liquid line 165. The refrigerant flowing into the first inflow pipe 166 expanses through the outdoor expansion valve 132 with the degree of opening controlled. The refrigerant expanding through the outdoor expansion valve 132 flows to the first distribution pipe 148*a* and the second distribution pipe 148*b*.

The refrigerant flowing to the second distribution pipe 148*b* flows to the second heat exchanging unit 143*b* through the second distributor 147*b*. The refrigerant flowing to the second heat exchanging unit 143*b* evaporates by exchanging heat with the air. The refrigerant evaporating in the second heat exchanging unit 143*b* flows into the second header pipe 141*b*.

In heating operation, the sluice valve 145 is closed, such that the refrigerant flowing into the second header pipe 141*b* cannot pass through the bypass pipe 144. The refrigerant flowing into the second header pipe 141*b* flows into the first header pipe 141*a* through the header check valve 142.

On the other hand, the refrigerant flowing into the first distribution pipe 148*a* passes through the distribution pipe check valve 146. In heating operation, since the sluice valve 145 is closed, the refrigerant flowing into the first distribution pipe 148*a* cannot flow to the second header pipe 141*b* and flows to the first heat exchanging unit 143*a* through the first distributor 147*a*. The refrigerant flowing to the first heat exchanging unit 143*a* evaporates by exchanging heat with the air.

The refrigerant evaporating in the first heat exchanging unit 143*a* flows into the first header pipe 141*a*. The refrigerant flowing into the first header pipe 141*a* meets the refrigerant that has passed through the second header pipe 141*b* and then sequentially flows to the second inflow pipe 167 and the compressor 110.

Although exemplary embodiments of the present invention are illustrated and described above, the present invention is not limited to the specific exemplary embodiments and may be modified in various ways by those skilled in the art without departing from the scope of the present invention described in claims, and the modified examples should not be construed independently from the spirit of the scope of the present invention.

According to an outdoor heat exchanger of the present invention, one or more of the following effects can be achieved.

First, the passage of a refrigerant is alternated in cooling and heating operation.

Second, cooling efficiency is improved by condensing again the condensed refrigerant in cooling operation.

Third, the cost is reduced by allowing the passage of a refrigerant to be alternated in cooling and heating operation and using only one outdoor expansion valve.

The effects of the present invention are not limited to those described above and other effects may be made apparent to those skilled in the art from claims.

What is claimed is:

1. An outdoor heat exchanger that operates as a condenser in cooling operation and as an evaporator in heating operation in an air conditioner, the outdoor heat exchanger comprising:

a first header pipe into which a refrigerant compressed by a compressor flows in cooling operation;

a first heat exchanging unit connected with the first header pipe and allowing a refrigerant to exchange heat with the air;

a bypass pipe through which the refrigerant exchanging heat in the first heat exchanging unit flows in cooling operation;

a first distribution pipe connected with the bypass pipe;

a first distributor to connect the first heat exchanging unit with the first distribution pipe;

a distribution pipe check valve that is disposed in the first distribution pipe and preventing the refrigerant exchanging heat in the first heat exchanging unit from passing through the first distribution pipe in cooling operation;

a second header pipe into which the refrigerant passing through the bypass pipe flows in cooling operation;

a second heat exchanging unit connected with the second header pipe and allowing a refrigerant to exchange heat with the air;

a second distribution pipe through which the refrigerant exchanging heat in the second heat exchanging unit passes in cooling operation, and a second distributor to connect the second heat exchanging unit with the second distribution pipe, wherein the first heat exchanging unit is composed of a plurality of refrigerant tubes and a plurality of thermal conducting fins, wherein one side of each of the refrigerant tubes of the first heat exchanging unit converge on the first header pipe and the other side of each of the refrigerant tubes of the first heat exchanging unit converge on the first distributor, wherein the second heat exchanging unit is composed of a plurality of refrigerant tubes and a plurality of thermal conducting fins, wherein one side of each of the refrigerant tubes of the second heat exchanging unit converge on the second header pipe and the other side of each of the refrigerant tubes of the second heat exchanging unit converge on the second distributor.

2. The outdoor heat exchanger of claim 1, wherein the second heat exchanging unit is disposed under the first heat exchanging unit.

3. The outdoor heat exchanger of claim 1, wherein the first header pipe is connected with the second header pipe, and the outdoor heat exchanger further includes a header pipe check valve disposed in the first header pipe and preventing a refrigerant from flowing into the second header pipe in cooling operation.

4. The heat exchanger of claim 1, further comprising a sluice valve disposed in the bypass pipe and controlling the flow of a refrigerant by opening/closing, wherein the sluice valve opens in cooling operation.

5. The outdoor heat exchanger of claim 1, further comprising:

a first inflow pipe on which the first distribution pipe and the second distribution pipe converge; and an outdoor unit expansion valve disposed in the first inflow pipe and controlling the degree of opening.

6. An air conditioner comprising:

a compressor; and an outdoor heat exchanger comprising, a first header pipe connected with the compressor, a first heat exchanging unit allowing a refrigerant to exchange heat with the air, one side of the first heat exchanging unit is connected with the first header pipe, a first distribution pipe connected with the other side of the first heat exchanging unit, a first distributor to connect the first heat exchanging unit with the first distribution pipe, a distribution pipe check valve disposed in the first distribution pipe and controlling the flow direction of a refrigerant, a bypass pipe connected with the first distribution pipe, a second header pipe connected with the first header pipe and the bypass pipe, a second heat exchanging unit allows a refrigerant to exchange heat with the air, one side of the second heat exchanging unit is connected with the second header pipe, a second distribution pipe that is connected with the other side of the second heat exchanging unit, a second distributor to connect the second heat exchanging unit with the second distribution pipe, wherein the first heat exchanging unit is composed of a plurality of refrigerant tubes and a plurality of thermal conducting fins, wherein one side of each of the refrigerant tubes of the first heat exchanging unit converge on the first header pipe and the other side of each of the refrigerant tubes of the first heat exchanging unit converge on the first distributor.

7. The air conditioner of claim 6, wherein the outdoor heat exchanger further comprises a header pipe check valve disposed in the first header pipe and controlling the flow direction of a refrigerant.

8. The air conditioner of claim 6, wherein the outdoor heat exchanger further comprises a sluice valve disposed in the bypass pipe and controlling the flow of a refrigerant by opening/closing.

9. The air conditioner of claim 6, wherein the outdoor heat exchanger further comprises, a first inflow pipe on which the first distribution pipe and the second distribution pipe converge, and an outdoor expansion valve disposed in the first inflow pipe and controlling the degree of opening.

* * * * *